United States Patent [19]

Chapuis

[11] 4,270,296

[45] Jun. 2, 1981

[54] POINT OF IMPACT ADJUSTMENT MEANS FOR FIREARM BARRELS

[76] Inventor: Paul Chapuis, rue de la Châtelaine, 42380 Saint Bonnet le Chateau, Loire, France

[21] Appl. No.: 969,999

[22] Filed: Dec. 15, 1978

[30] Foreign Application Priority Data

Dec. 29, 1977 [FR] France ..... 77 39942

[51] Int. Cl.[3] ..... F41C 21/08

[52] U.S. Cl. ..... 42/76 R

[58] Field of Search ..... 42/76 R, 75 A, 75 B

[56] References Cited

U.S. PATENT DOCUMENTS

| | | | |
|---|---|---|---|
| 1,468,902 | 9/1923 | Fabry et al. | 42/76 R |
| 1,785,765 | 12/1930 | Burton | 42/76 R |
| 3,365,831 | 1/1968 | Wallace | 42/76 R |
| 3,651,594 | 3/1972 | Hillberg | 42/76 R |

FOREIGN PATENT DOCUMENTS

| | | | |
|---|---|---|---|
| 995121 | 8/1951 | France | 42/76 R |
| 269976 | 4/1927 | United Kingdom | 42/76 R |

*Primary Examiner*—Charles T. Jordan

*Attorney, Agent, or Firm*—Eric P. Schellin

[57] ABSTRACT

A profiled band for sporting guns permitting accurate adjustment of the barrel tubes. The band extends along the entire length of the barrel tubes, with a longitudinally flattened and profiled section. The band is provided along its lateral faces with symmetrical recesses to be centered and fitted between the barrel tubes along the common horizontal axis thereof.

7 Claims, 13 Drawing Figures

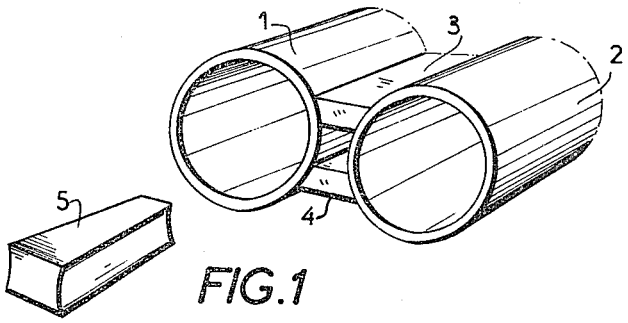
FIG.1
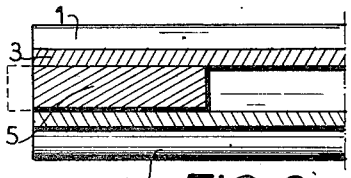
FIG.2
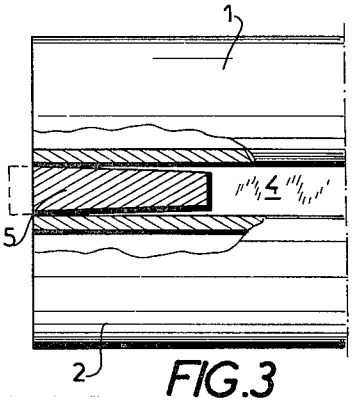
FIG.3
FIG.4
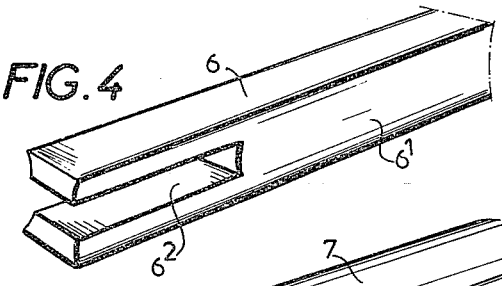
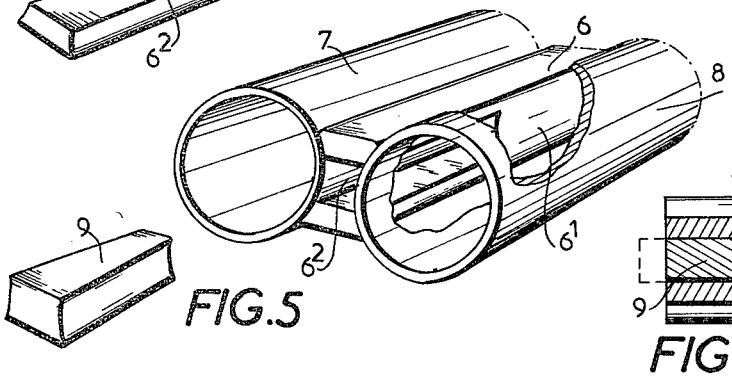
FIG.5
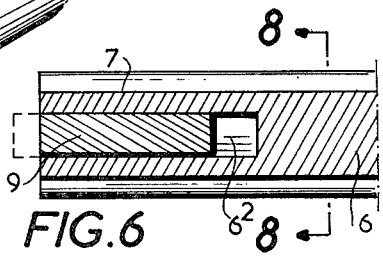
FIG.6
FIG.7
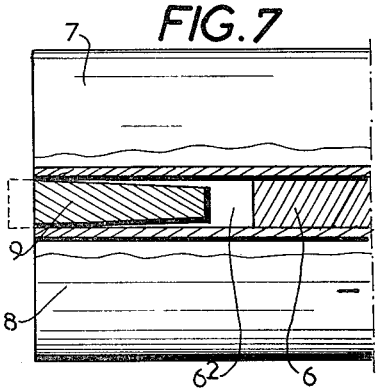
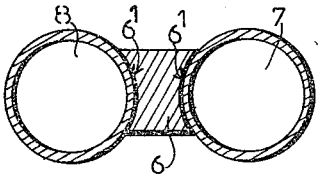
FIG.8

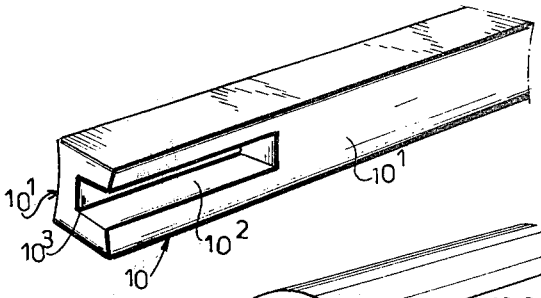
FIG. 9
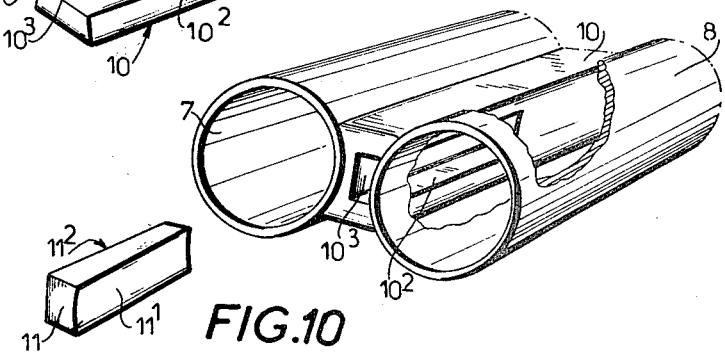
FIG. 10
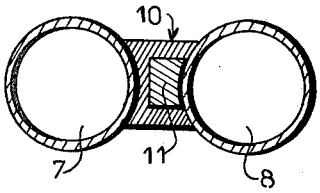
FIG. 13
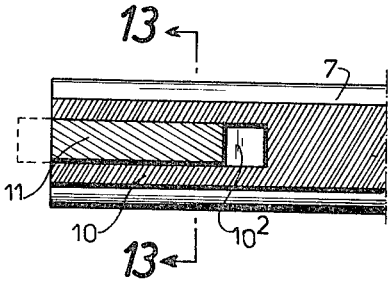
FIG12
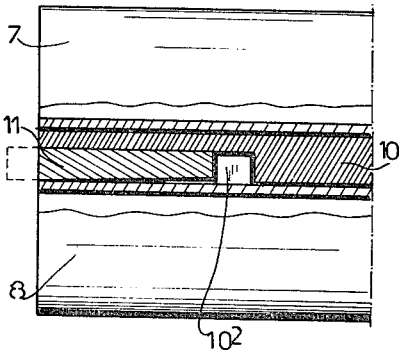

POINT OF IMPACT ADJUSTMENT MEANS FOR FIREARM BARRELS

This invention relates to arms, and more particularly to individual firearms with bullets necessitating a high impact point accuracy.

In well known guns of this type, with juxtaposed barrels, the connection of said barrels is provided along their whole length by means of profiled and spaced bands of flattened cross-section that are fitted by their transversal sides along the generatrices, and symmetrically to the common longitudinal axis.

Due to their spacing, it is difficult to position these bands while providing some contact with the barrels. The latter show therefore a substantial distortion relatively to one another, which necessitates a taking up either of their horizontal spacing or of their offsetting in a horizontal plane. This correction is effected by means of a V-shaped wedge which is more or less keyed in between the bands along the front ends of the barrels, after having previously unwelded a portion of the length of said bands.

The profiled single band forming the subject matter of the present invention eliminates these disadvantages, and has along its entire length a flattened and profiled cross-section which is provided along its lateral sides with symmetrical recesses for centering between the two barrels along their common horizontal axis to provide a faultness and controlled connection of their alignment, while ensuring a substantial stiffness.

According to a further characteristic, this single band is at the front end thereof split longitudinally and transely entirely or in part to permit, due to the opening thereof, the engagement and the adjustment of a profiled wedge for the possible but always unimportat taking up of the horizontal spacing of the barrel tubes.

These and other characteristics will be readily apparent from the following description, with reference to the attached drawings, illustrating the object of the invention without however restricting it to said drawings, in which:

FIG. 1 is on a small scale a fragmentary perspective view illustrating the front end of two juxtaposed barrel tubes which are connected in a known manner by two profiled bands, while a V-shaped wedge is shown opposite to allow the adjustment and the spacing of said barrel tubes;

FIG. 2 is a fragmentary view in longitudinal section between the two barrel tubes, illustrating in a known manner the endwise engagement of the V-shaped wedge between the profiled bands for the adjustment of the spacing of the barrel tubes;

FIG. 3 is a plan view, with fragmentary cross section, corresponding to FIG. 2;

FIG. 4 is a perspective view of the profiled band made in accordance with the invention in a first form of embodiment;

FIG. 5 is a perspective view illustrating the profiled band in accordance with the first form of embodiment, positioned between the barrel tubes. A V-shaped wedge is shown facing the split end of the profiled band for the adjustment of the spacing of the barrel tubes;

FIG. 6 is a fragmentary view in longitudinal section between the two barrel tubes, illustrating the engagement of the V-shaped wedge at the end of the profiled band made in accordance with the first form of embodiment;

FIG. 7 is a plan view with fragmentary cross section, corresponding to FIG. 6;

FIG. 8 is a cross-sectional sideview along the line 8—8 of FIG. 6;

FIG. 9 is a perspective view of the profiled band, in accordance with a second form of embodiment;

FIG. 10 is a perspective view illustrating the profiled band in accordace with a second form of embodiment, and positioned between the barrel tubes. One wedge, with a single slanting side, is shown facing the partly slit end of the profiled band, for the adjustment of the spacing of one barrel tube only;

FIG. 11 is a fragmentary view in longitudinal section between the two barrel tubes, illustrating the engagement of the wedge at the end of the profiled band, in accordance with the second form of embodiment;

FIG. 12 is a plan view with fragmentary cross section, corresponding to FIG. 11;

FIG. 13 is a cross-sectional side view along the line 13—13 of FIG. 11.

To make the object of the invention more concrete, this object will be now described in connexion with the Figures of the drawings, without restricting it to said Figures.

FIG. 1, 2 and 3 are a reminder of the well-known embodiment for the connection of the juxtaposed barrel tubes 1 and 2 by means of bands 3 and 4 of flattened cross-section, vertically spaced apart from one another and fitted by their transversal sides along the entire length of said tubes.

When performing the adjustments as well horizontally as vertically of the barrel tubes 1 and 2 which are necessary for imparting a higher accuracy of common impact point to said tubes, a wedge 5 is more or less engaged at the end of the barrel tubes 1 and 2 and between the bands 3 and 4, after having unwelded previously a certain portion of their length. After adjusting, a new welding of the bands 3 and 4 and of the wedge 5 is performed to make them fast with the barrel tubes 1 and 2.

According to the invention, the band 6 is single, with a symmetrical and thick corss-section to form on either side and along its lateral faces symmetrical and rounded recesses $6^1$ for the abutment and the centering of the barrel tubes 7 and 8, along an axial and transversal position and an endwise contour, in order to provide by welding a faultlessly rigid and controlled connection of said tubes 7 and 8 and an optimal alignment.

In the first form of embodiment illustrated in FIGS. 4, 5, 6, 7 and 8, the front end of the band 6 is split endwise at $6^2$, entirely in the common transversal axis of the barrel tubes 7 and 8 and along a sufficient length to allow the possible engagement of a V-shaped wedge 9. The opposite and symmetrically slanted transverse faces of this wedge 9 co-operate with the longitudinal ends facing said tubes 7 and 8 for the possible plus or minus adjustment of their horizontal spacing.

It will be noted that this horizontal adjustment, practically of a reduced value, is performed after having released the band 6 by unwelding, and relatively to the barrel tubes 7 and 8, in order to allow their distortion during the movement of the wedge 9. After the adjustment, the band 6 and the wedge 9 are secured again by welding.

In the second form of embodiment illustrated in FIGS. 9, 10, 11, 12 and 13, the band 10 has still a symmetrical cross-section to form on either side and along its lateral faces symmetrical and rounded recesses $10^1$ for the abutment and the centering of the barrel tubes 7 and 8.

The front end of the band 10 is split longitudinally at $10^2$ and in part to form a squared abutting face $10^3$. The length of the slot $10^2$ is sufficient to allow the possible engagement of a wedge 11 of which one lateral face only, the lateral face $11^1$, is slanted. The opposite lateral face $11^2$ of the wedge 11 cooperates with the abutting squared face $10^3$ of the band 10, while the slanted face $11^1$ cooperates with a longitudinal end facing one of the tubes 7 or 8 for moving horizontally away one only of the barrel tubes for the adjustment of the impact point.

As in the preceding embodiment, this horizontal adjustment is performed on one only of the tubes 7 or 8 after having released the open face of the band 10 by unwelding and relatively to one of the tubes in order to allow the distorsion of one of said tubes when the wedge 11 is moving. After the adjustment, the band 10 and the wedge 11 are secured again by welding.

It will be also noted that with this solid band 6 or 10, the vertical adjustment of the barrel tubes 7 and/or 8 is also made possible after unwelding the end of the band 6 or 10. It will be seen however that this vertical adjustment is practically of no value owing to the faultness rigidity and guiding of the barrel tubes 7 and 8 due to the section and the shape of the band 6 or 10.

The advantages will be readily apparent from the description, and more particularly:

the very small distortion and offsetting of the barrel tubes due to the single and profiled band while allowing however the accurate adjustment of the impact point;

the easy engagement of the band between the barrels:

the faultless centering and the controlled connection of the rear portion of the barrel tubes along a substantial length;

the easy adaptation to bullet guns for which an accurate adjustment of the barrel tubes is required in view of a high accuracy of the impact point.

It is obvious that this band of any suitable longitudinal shape can form or not a line of sight with the upper portion thereof.

The invention is in no way limited to the use nor to the forms of embodiment which have been more particularly described therein; on the contrary, it will be understood that all alternative forms of embodiment are comprised within the scope of the invention.

I claim

1. A profiled band for sporting guns having barrel tubes, allowing accurate adjustment of the barrel tubes, characterized in that the band extends along the entire length of the barrel tubes with a longitudinally flattened and profiled section, and is provided along its lateral faces with symmetrical recesses to be centered and fitted in the external profile of the barrel tubes and between the barrel tubes along the common horizontal axis thereof, the band being recessed axially and transversely at the front end to allow by its opening the engagement and the adjustment of the barrel tubes.

2. The profiled band of claim 1, characterized in that the axial recess of the front end allows engagement of a regulating wedge of which the opposite sides are sloped according to the ends of the barrel tubes.

3. The profiled band of claim 1, wherein the axial recess of the front end is shaped with one side marked for engagement with a regulating wedge having one slanted transversal face only when the band is split longitudinally and transversely.

4. The profiled band of claim 2, characterized in that the recess thereof is made of a sufficient length to allow the unwelding of the barrel tubes relative to the band in order to allow the adjustment of the spacing of the tubes when a V-shaped wedge is engaged to take up the horizontal spacing of the barrel tubes.

5. The profiled band of claim 4 characterized in that after the adjustment of the spacing of the barrels, the V-shaped wedge and the released portion of the band are welded again on the barrel tubes.

6. The profiled band of claim 3 characterized in that the recess thereof extends a sufficient length for the unwelding of one of the barrel tubes relative to the open face of the band, in order to allow the adjustment of one tube only upon engagement of the wedge.

7. The profiled band of claim 6 characterized in that after the adjustment of one barrel only, the wedge and the released portion of the band are welded again on the barrel tube.

* * * * *